United States Patent [19]

Brown et al.

[11] Patent Number: 4,535,845

[45] Date of Patent: Aug. 20, 1985

[54] METHOD FOR PRODUCING VISCOUS HYDROCARBONS FROM DISCRETE SEGMENTS OF A SUBTERRANEAN LAYER

[75] Inventors: Alfred Brown; Wann-Sheng Huang; Yick-Mow Shum, all of Houston, Tex.

[73] Assignee: Texaco Inc., White Plains, N.Y.

[21] Appl. No.: 528,672

[22] Filed: Sep. 1, 1983

[51] Int. Cl.[3] ..... E21B 43/24

[52] U.S. Cl. ..... 166/272; 166/252

[58] Field of Search ..... 166/50, 245, 252, 271–274, 166/263

[56] References Cited

U.S. PATENT DOCUMENTS 4,390,067 6/1983 Willman ..... 166/272

4,434,849 3/1984 Allen ..... 166/272

*Primary Examiner*—Stephen J. Novosad

*Assistant Examiner*—William P. Neuder

*Attorney, Agent, or Firm*—Robert A. Kulason; Robert B. Burns

[57] ABSTRACT

Method for producing viscous hydrocarbon products such as heavy crude oil or bitumen from tar sands, which products must be thermally converted into flowable condition. A discrete vertical subsection of a productive subterranean layer is marginated by a pair of spaced apart vertical wells and a horizontal well that lies substantially horizontal to the vertical wells. Controlled, pressurized flows of a heating medium such as steam are introduced to one of the vertical wells and to the horizontal well, whereby to establish a controlled thermal front. The latter is progressively urged by the pressurized steam, through the discrete vertical subsection and toward the other of the vertical wells at which hydrocarbon emulsion is produced.

2 Claims, 7 Drawing Figures

STEAM OVER RIDE IN A CONVENTIONAL STEAM FLOOD

PRESENT STEAM STIMULATION

Legends:

- VERTICAL INJECTION WELLS
- VERTICAL PRODUCTION WELLS
- H-1, H-8 HORIZONTAL WELLS
- O HORIZONTAL WELL PAD
- — — PATTERN BOUNDARY

METHOD FOR PRODUCING VISCOUS HYDROCARBONS FROM DISCRETE SEGMENTS OF A SUBTERRANEAN LAYER

BACKGROUND OF THE INVENTION

The production of viscous hydrocarbons and bitumen from tar sands, is not readily achieved without some form of production enhancement. Among the most widely utilized of the enhancement steps is to thermally treat the productive layer thereby to encourage the rate of production. This form of enhancement normally constitutes the introduction of a heating medium, usually hot water or steam, directly into the substrate.

The effects of this introduction of pressurized heating medium is two-fold. Firstly the elevated temperature heats the hydrocarbon product to increase its mobility, or stated otherwise, to decrease its viscosity. Secondly, the presence of the pressurized heating media within a substrate tends to force the movable hydrocarbon toward a lower pressure zone. The latter is normally established by the positioning of a producing well, in such a location within the substrate as to receive the pressurized flow.

In one of the most commonly practiced methods of this enhanced recovery procedure, pressurized steam, functioning as the heating medium is introduced or flooded into a single well whereby to be discharged through perforations in the latter and into the substrate. The heated and flowable hydrocarbon emulsion is caused to move toward the producing well.

Rather than producing from a remotely positioned well, the huff and puff method can be utilized. In the latter, a single well is provided with a heating medium such as steam, to establish a heated environment. Thereafter the well is closed in to permit the heat to penetrate into a wider area of the substrate. Subsequently, the well is activated to produce the now flowable hydrocarbon or bitumen therefrom.

In any steam flood or thermally stimulated operation, because the steam enters at a high temperature and under substantial pressure there will be a natural propensity for it to rise through the earthen productive layer. The rate of rise will depend on the composition of the substrate and on the length of time to which it is subjected to the pressurized injection of heating medium.

In either event, the heating medium will eventually cause the hydrocarbon flow to break through the substrate and into a producing well. Logically, the heating medium will tend to follow the path of least resistance through the substrate. Thus, it will establish the necessary heating step which gradually liquefies the retained bitumen or viscous petroleum.

The composition of the substrate will be a major factor in determining the effect of the injected steam and its passage through the productive layer. As noted, the steam will tend to rise through the productive layer while contacting the viscous hydrocarbon.

Over a period of time, this continued pressurized introduction of heating medium will cause the steam to override a portion of the hydrocarbon containing layer and move directly to the producing well. The result of such action is that a considerable portion of the productive layer is completely bypassed. The hydrocarbon held therein will remain unheated and in place since its condition is not affected by the steam.

Toward overcoming or obviating this presence of an unproductive hydrocarbon layer in the midst of a highly productive area, the present method is disclosed. Specifically, the function of the heating and stimulating medium is maximized by introducing it directionally into a limited area. Thus, a substantially vertical subsection of the substrate layer is segreated by a series of wells which tend to marginate said subsection. These wells are comprised of at least two horizontally spaced and vertically disposed wells. In addition, one third well is positioned to extend in a substantially horizontal direction passing adjacent to the bottoms of the respective vertical wells.

By the controlled introduction of the heating medium, such as steam into two of these wells, a thermal front can be established in the segregated subsection. This front, by virtue of the pressurized heating medium, is caused to advance laterally through the productive layer.

It is therefore an object of the invention to provide an enhanced recovery technique for producing viscous hydrocarbon products which must first be put into flowable condition before being produced. Another object is to provide a method for producing viscous hydrocarbons or bitumen from a tar sand formation by the controlled introduction of a heating medium into the productive layer. Still another object of the invention is to provide a method for producing viscous hydrocarbon products from a subterranean layer by establishing a thermal front within the layer which advances horizontally toward a producing well.

DESCRIPTION OF THE DRAWINGS

The various figures included herewith graphically represent an elevation, cross-sectional view through a hydrocarbon containing substrate.

Referring to the drawings, FIG. 1 illustrates a cross-sectional elevation view of a hydrocarbon holding layer L which is subjected to an enhanced oil recovery treatment. Production of the contained hydrocarbon is stimulated by the introduction of a pressurized flow of a hot stimulating fluid such as steam into the single vertical well A.

Such wells as here contemplated are perforated along the length thereof which lies in the productive layer L. Thus, injection of steam or other thermal stimulating fluid into the substrate will occur along the entire length of the injection well.

Since the stimulating steam will tend to rise through the productive layer, over a period of time the steam front and consequently the heated area of the substrate will progress toward producing well B. Concurrently, however, the hot steam will rise toward the upper layer of the productive substrate.

Figure 1:
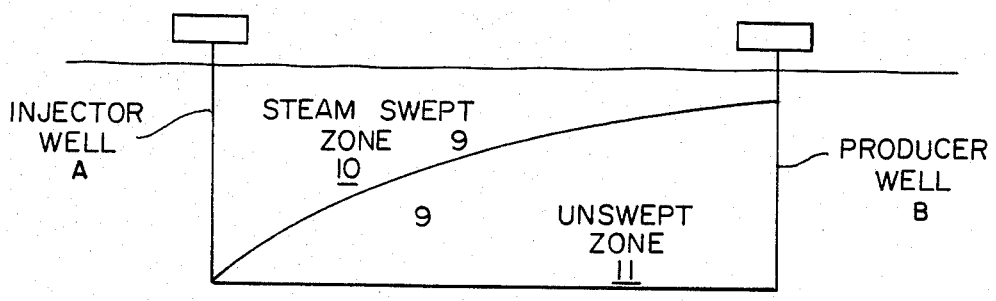
FIG. 1 PRIOR ART
FIG. 1 represents a substrate in which spaced apart injection and producing wells A and B are inserted, and into which substrate a pressurized flow of steam is introduced by way of the injection well A. The production of hydrocarbon product takes place through well B.

As shown in FIG. 1, the overall result of this action will be that only part 10 of the productive layer L is swept by the stimulating steam. The remaining segment 11, which is remote from injection well A, will remain substantially unswept. To all intents, the hydrocarbons in this unswept area 11 will remain viscous and thus unproduced.

Figure 2:
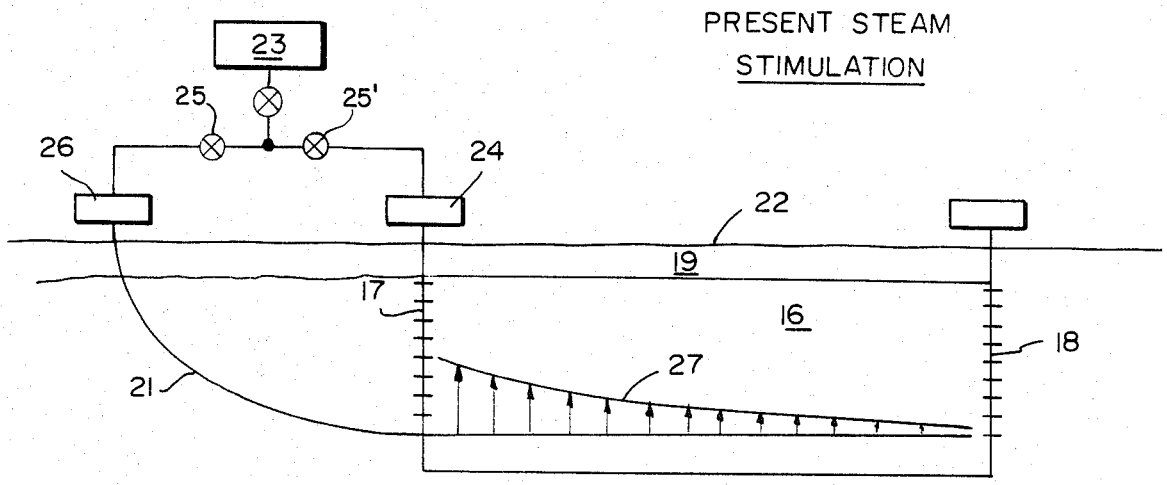
FIGS. 2 through 5 illustrate a hydrocarbon producing substrate into which two vertical wells, as well as a horizontal well have been inserted. The wells are arranged to thermally stimulate and produce hydrocarbons from a limited area.

Referring to FIG. 2, and according to the invention, a more complete draining, and fuller utilization of a particular hydrocarbon producing substrate 16 can be realized. This is achieved by in effect segregating the productive layer 16 into discrete vertical subsections. Thereafter, by controlled and selective introduction of stimulating steam into the subsection, the capability and potential of the injected steam will be utilized to its greatest capacity.

The economic affect of the disclosed method will result in a more efficient use of the productive substrate and further. Further, the method will yield a greatly reduced cost per barrel of hydrocarbon product produced.

As shown in FIG. 2, the particular subsection 16 of the hydrocarbon containing layer, is enclosed or marginated within a basic pattern of three wells.

The productive subsection from which the hydrocarbon will be extracted can lie immediately beneath the surface. Quite often, however, hydrocarbon containing layers of this type are found between, and bounded by non-productive layers. Productive layers are also found in different thicknesses, some being quite thin while others are found to be several hundred feet in thickness.

For the instant disclosure, and with no intention of limiting the scope of the claimed subject matter, the method hereinafter will be described with respect to production of a tar sand layer which lies beneath an overburden of a non-hydrocarbon productive earthen layer. Also, a number of heating mediums can be utilized to achieve the desired stimulation of the viscous hydrocarbon. The novel method will however be hereinafter described for convenience with respect to injection of pressurized steam of varying quality.

In a preferred embodiment of a pattern of wells which are positioned to achieve the instant objectives, at least three wells are formed into a subterrean productive subsection. These wells are positioned in a manner to in effect generally marginate the three borders of the limited area to be selectively produced. The respective wells include two, 17 and 18, which penetrate overburden 19 at a substantially vertical alignment. Said wells bottom out adjacent to the lower end of the tar sand layer.

These two spaced apart wells 17 and 18 are generally aligned in the normal or upright, vertical position. The third well 21, however, is preferably commenced in a vertical or slanted alignment at the surface 22 to initially penetrate overburden 19. Thereafter, said third well, after entering the tar sand layer is in a substantially horizontal position.

Well 21 can be diverted from its vertical or slanted alignment as it progresses deeper through overburden 19. It is then diverted into its horizontal position toward or adjacent to the lower end of said productive layer 16. It is then continued in a horizontal position along the lower side of said layer.

All of the well casings utilized in the horizontal as well as the vertical wells, are at least partially perforated. The perforations can be pre-made prior to the well casing being inserted into a well bore, or subsequent to insertion of the casing. In either instance, the perforated portions of the casing will lie within the tar sand layer to best function in a manner to inject steam into the substrate and/or to receive the flowing hydrocarbon emulsion therefrom.

In the normal manner, for carrying out a steam flood operation, steam is received from a source 23 such as a steam generator disposed relatively close to the various well heads 24 and 26. Suitable valve connections 25 and 25' between said source 23 and the various well heads will permit the controlled and selective introduction of flows of steam through the various wells in a manner to best achieve the objectives of the invention.

Structurally, the various wells, both horizontal and vertical, are formed into a substrate after a determination has been made regarding the character and composition of the productive layer. Vertical wells as in the instance of most productive wells 17 and 18, are initially spudded downwardly in a vertical direction. The well bore is continued downwardly to penetrate the overburden layer 19 and tar sand layer 16.

When the latter is found beneath a substantial thickness of overburden, the well bore can be provided with the necessary casings which progressively decrease in diameter until the desired casing size is ultimately inserted into the productive layer 16. This latter casing as herein noted can be pre-perforated along its length before being inserted and fixed into place. However, the casing can also be inserted as to reside within the productive layer, and thereafter perforated in a manner to permit the desired discharge of stimulating fluid into the productive subsection 16.

Depending on the composition of the substrate wherein the hydrocarbons are held, casing perforations can take the form of a series of narrow slots rather than through holes through which the produced hydrocarbons will flow. These slots can be designed to readily allow the flow of hydrocarbon emulsion and yet minimize the flow of sand which is normally carried from the substrate by the flowing emulsion.

Broadly speaking, the preferred method for producing according to the invention resides in the segregation of a discrete productive subsection 16 of a productive subterranean layer. The subsection to be initially produced is in effect at least partially bounded by or marginated by the above noted three wells 17, 18 and 21 disposed respectively at either lateral ends of the subsection and along the bottom thereof.

To commence and sustain a flow of hydrocarbon fluid or emulsion from the subsection, a pressurized flow of steam is introduced to said subsection from multiple directions. The latter are preferably from the underside by way of well 21, as well as laterally from injection well 17. This injection of stimulation by steam injection will cause the limited subsection to be preheated in anticipation of the subsequent production step.

Thereafter, the lateral flow of stimulating steam from the injection well 17 will cause a thermal front to be established. Under the influence of the pressure of both steam flows at wells 17 and 21, the thermal front will be caused to advance laterally through the substrate and toward producing well 18. Thereafter, the heated hydrocarbon product normally in the form of viscous oil, or bitumen emulsion which has formed from steam condensate, can be received in the well 18 and product.

To best achieve the preheating step of the productive subsection, a flow of pressurized steam is initially introduced by way of well head 26 through horizontal well 21 to the lower side of the productive layer 16. As seen in FIG. 2, this initial introduction of steam will take place along the entire horizontal length of well 21. However, due to the gradual pressure drop-off in the steam as the well progresses toward its remote end, the injected steam will define a temperature profile 27 approximately as illustrated in FIG. 2.

During this initial preheating period, the temperature of the substrate adjacent to the area about the horizontal well 21 will be progressively raised. The viscous hydrocarbon or the bitumen will thereby become less viscous, or in the case of the bitumen will become flowable. The bitumen emulsion, will gravitate downwardly and into horizontal well 21 thus establishing voids through the substrate immediately adjacent to well 21.

Figure 3:
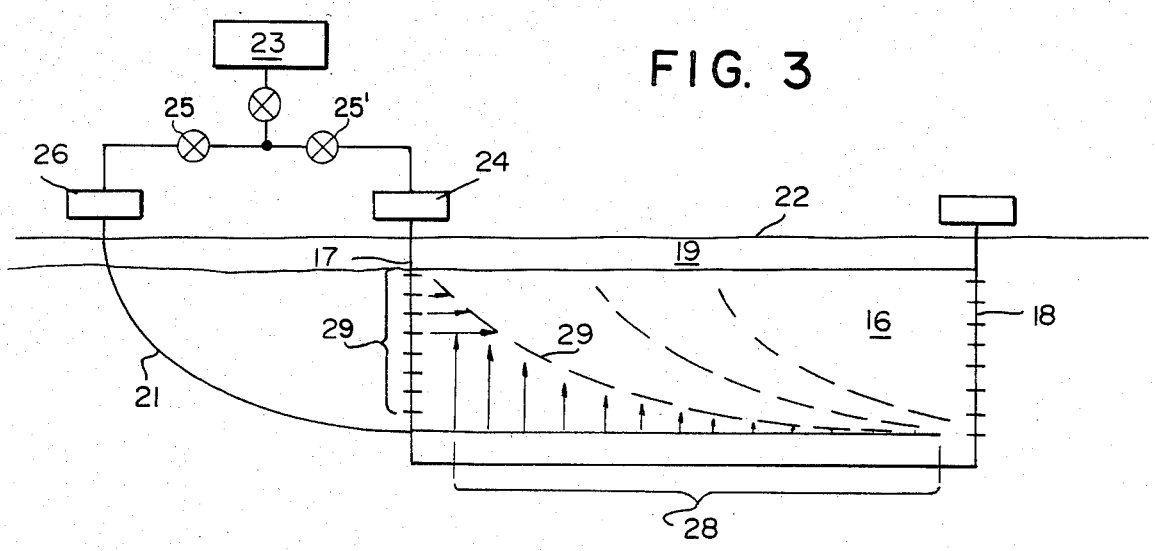

After the initial preheating of the productive substrate 16 has been achieved, introduction of a secondary flow of steam by way of injection well 17 can proceed. Such injection by way of flows 28, will result as shown in FIG. 3, of a laterally moving steam front which combines with the upwardly moving steam from the horizontal well 21. The two combined fronts define an aggregate thermal front as defined by the line 29.

As herein mentioned, cavitation of, and forming of voids in the substrate during the opreheat period will take place. Thus, steam from the injection well 17 will penetrate more rapidly through the substrate and toward the remote end of horizontal well 21. The advancing thermal front as defined by a relatively constant temperature, will assume a curvature approximately as shown and designated at 29, of about 400° F. In a similar manner, and as shown in FIG. 3, the areas remote from the two steam injection sources 17 and 21 will define spaced apart temperature curvatures of 300° and 200° F.

The character of the steam introduced into the substrate to achieve the stimulating action will be adjusted in accordance with the conditions prevailing within the substrate. For a relatively deep productive layer it is understood that the necessary steam pressure for penetrating the earthen productive layer will be substantially greater than when the layer is near to the earth's surface.

The temperature of injected stimulating steam for the herein noted method can vary with a range of about 212° F. to 750° F.

In either instance, steam which is introduced to both vertical and horizontal wells, and which is subsequently combined within the substrate to form the aggregate thermal front, need not be of equal quality nor injected under equal conditions. The temperature and pressure of the multi-directional flows, that is from horizontal and vertical, should however be relatively compatible. This is desirable in order that an orderly flow of the combined steam fronts will tend to move the aggregate thermal front laterally through the productive layer and toward well 18.

The affect of incoming steam from both the horizontal and vertical wells on the substrate is monitored during the entire stimulating step. This can be achieved in one way through use of thermocouples and similar pressure sensitive instruments which are embedded into the substrate in a desired pattern to be in the path of the advancing thermal front.

By monitoring the changing conditions within the subsection 16, the rate of flow as well as the temperature and pressure of injected steam whether vertically or horizontally injected, can likewise be regulated to achieve the desired laterally advancing thermal front.

One or both of the wells 17 and 21 being utilized for steam stimulation can be provided with packers or similar equipment which functions to limit the length of well along which the steam is injected. Thus, one or more blocking members, such as well packers can be inserted into the respective wells and positioned. Said members can be subsequently adjusted during the steam injection period to assure that the desired outflow of steam from both horizontal and vertical sources is properly regulated.

Figure 4:
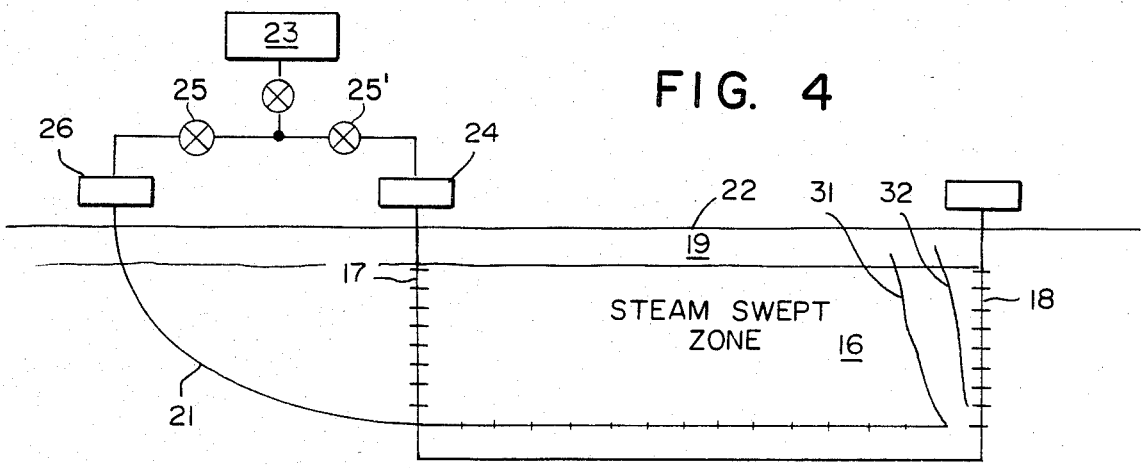
Figure 5:
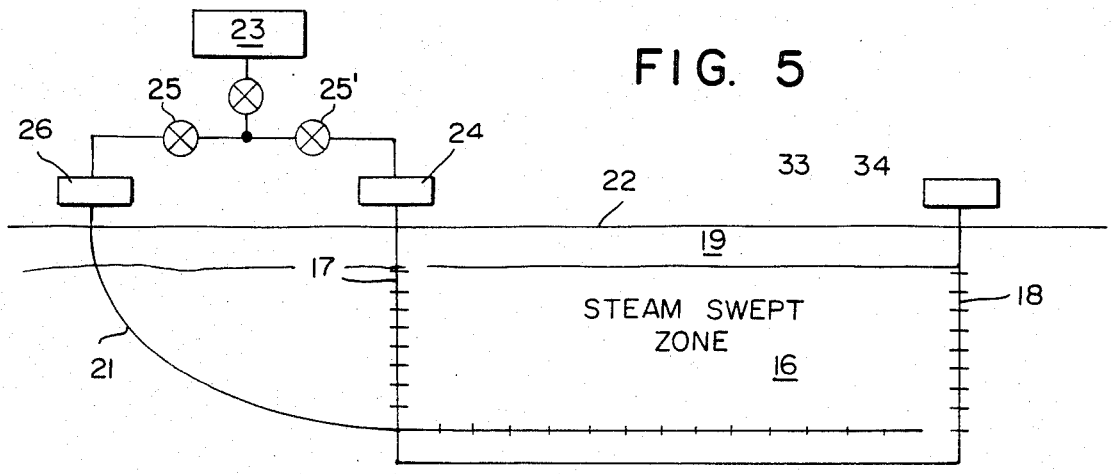

Over an extended period of operating time, and referring to FIGS. 4 and 5, the thermal fronts within productive layer 16 as characterized in FIG. 4 by the lines 31 and 32 respectively designating 400° and 300° F. temperatures, will advance toward the producing well 18. This pressurized thermal front will progressively drive the less viscous hydrocarbon toward said producing well so that the hydrocarbon emulsion can be produced. Concurrently, and as shown in FIG. 5, as the productive layer becomes more thoroughly heated, and produced, the degree of oil saturation thereof, shown as curves 33 and 34, will be decreased as a function of the temperature.

During both the preheating and the subsequent producing period and as noted herein, a considerable amount of the viscous crude or the bitumen will be initially put into flowable condition. It will gravitate downwardly toward horizontal well 21. Thus, for a limited period the latter can function as both an injection and as a production well by operating on the huff and puff sequence. This will of course be mandated by the amount of hydrocarbon emulsion which does flow downward to accumulate in lower well 21.

By regulating the cycling of said well through sequential heating and productive steps, the condition of the substrate thereabove can be controllably maintained to sustain the lateral movement of the thermal front toward the producing vertical well 18.

After a period of the above noted thermal treatment of the productive substrate 16, breakthrough at the producing well 18 will result. Further, after a period during which the hydrocarbon emulsion is produced, a point will be reached when a substantial amount of the output from producing well 18 is found to be the injected stimulating steam.

This circumstance will indicate a substantial depletion of hydrocarbon from the productive layer 16 and the free passage of stimulating steam through the thereby created voids. At this point, the process can be considered as being completed or non-productive.

Figure 6:
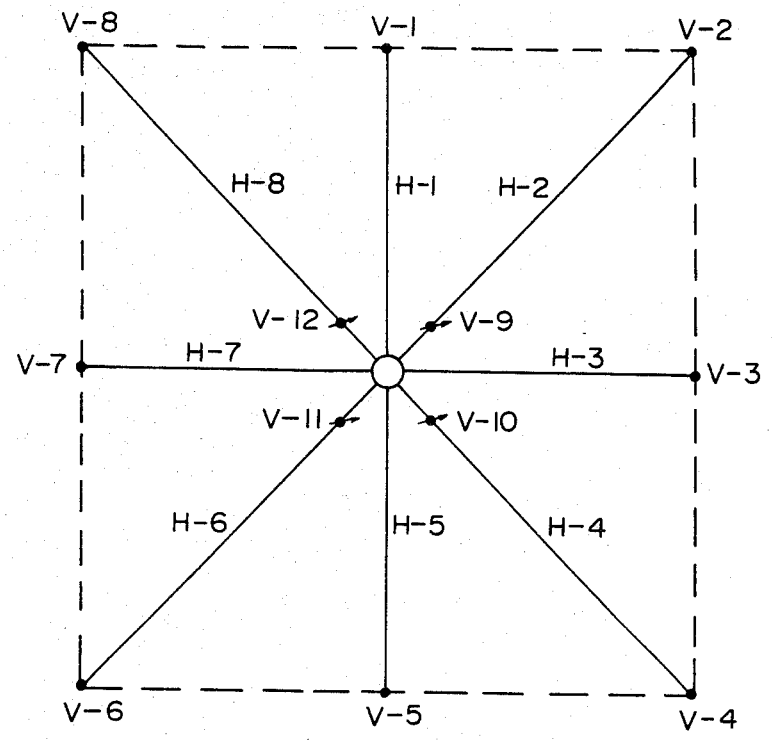
FIGS. 6 and 7 illustrate a pattern of wells in which the novel method can be practiced.

Referring to FIG. 6, to apply the presently disclosed method to a relatively large field or productive layer, a series or pattern of well combinations can be inserted in the field. Thus, the arrangement of wells to form the combined vertical and horizontally defined subsection of the productive layer, can be as shown in FIG. 6.

Here, the respective wells are arranged in a generally square-like pattern, combining both the horizontal and vertical wells.

Figure 7:
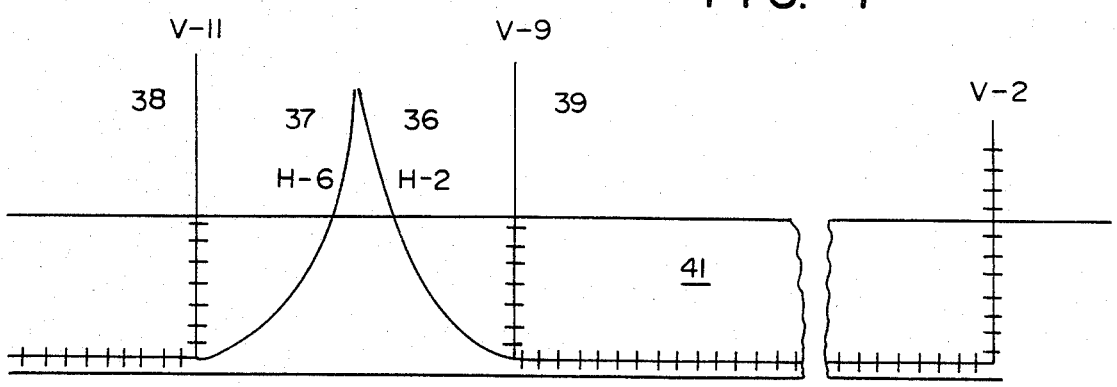

As seen in FIG. 7, the respective horizontal wells 36 and 37 can be commenced or spudded at a common point at approximately the center of the field. Thereafter, the various vertical wells 38, 39 and 40 are judicially placed about said center to best effectuate the injection of steam into a particular discrete subsection of the productive layer 41.

The outer or remote edges of the square pattern of FIG. 6 are provided with a series of vertical producing wells designated as V1 to V8 inclusive. These, as shown, are formed to terminate adjacent to the remote end of the various horizontal wells H1 to H8, respectively.

The pattern is completed by a series of vertical injection wells V9 to V12 which are disposed closely adjacent to the center of the pattern.

It should be understood that there is no particular sequence in forming the various horizontal and vertical wells into a substrate to establish the above noted pattern. It is understandable, however, that at such time as the pattern is formed, the selective introduction of steam and the production of vertical subsections of the producing area should be regulated such that the volume of steam is most effectively utilized.

Thus, a progression of hydrocarbon production can be made by sequentially producing from the various wells at the outer periphery of the pattern. Concurrently, the various horizontal wells, as well as the vertical injection wells, are selectively stimulated in such manner that each vertical segment of productive layer will be heated only in its limited subsections as herein noted.

The invention has been described as embodying basically two spaced apart vertical wells, together with a horizontal well. Further, the horizontal well extends adjacent to or in the vicinity of the lower ends of the respective vertical wells.

Although the foregoing illustrates one preferred embodiment of the invention, the novel method can be practiced particularly by varying the character of the horizontal well. For example, the latter need not extend for the full distance between the two vertical wells. The aggregate front can be established to effectively sweep the substrate section, if the horizontal well extends for only a part of the distance between said vertical wells.

Although modifications and variations of the invention may be made without departing from the spirit and scope thereof, only such limitations should be imposed as are indicated in the appended claims.

We claim:

1. Method for producing viscous hydrocarbon from a productive substrate layer in which the hydrocarbon is releasably held, which method includes the steps of;

segregating a discrete vertical subsection of said substrate layer which is marginated between a pair of laterally spaced, substantially vertically oriented wells, and at least one other well, a portion of the latter being disposed substantially horizontal, and positioned adjacent to the bottom of the laterally spaced vertical wells, said respective vertical walls and at least one other well, being perforated along a portion of the lengths thereof which contacts the productive substrate layer, preheating said discrete vertical subsection, introducing multi-directional flows of a pressurized heating medium concurrently from one of said vertical wells and the horizontal well respectively, into said vertical subsection to form thermal fronts in the productive layer, which fronts combine to establish an aggregate thermal front which is urged toward the other of said laterally spaced vertically oriented wells, producing hydrocarbon from said other vertically oriented well, and the production of hydrocarbon from said vertical subsection by way of said at least one other well is achieved prior to the introduction of said multi-directional flows of heating medium thereto, and subsequent to said vertical subsection becoming preheated.

2. Method for producing viscous hydrocarbon from a productive substrate layer in which the hydrocarbon is releasably held, which method includes the steps of;

segregating a discrete vertical subsection of said substrate layer which is marginated between a pair of laterally spaced, substantially vertically oriented wells, and at least one other well, a portion of the latter being disposed substantially horizontal, and positioned adjacent to the bottom of the laterally spaced vertical wells, said respective vertical walls and at least one other well, being perforated along a portion of the lengths thereof which contacts the productive substrate layer, preheating said discrete vertical subsection, introducing multi-directional flows of a pressurized heating medium concurrently from one of said vertical wells and the horizontal well respectively, into said vertical subsection to form thermal fronts in the productive layer, which fronts combine to establish an aggregate thermal front which is urged toward the other of said laterally spaced vertically oriented wells, producing hydrocarbon from said other vertically oriented well, sequentially preheating and producing hydrocarbon from the vertical subsection by way of said at least one other well, prior to the introduction of said multi-directional flows of heating medium thereto.

* * * * *